US010490896B1

(12) United States Patent
Wu

(10) Patent No.: US 10,490,896 B1
(45) Date of Patent: Nov. 26, 2019

(54) ANTENNA DEVICE

(71) Applicant: LANNER ELECTRONICS INC., New Taipei (TW)

(72) Inventor: Jung-Tai Wu, Taipei (TW)

(73) Assignee: LANNER ELECTRONIC INC. (TW)

( * ) Notice: Subject to any disclaimer, the term of this patent is extended or adjusted under 35 U.S.C. 154(b) by 0 days.

(21) Appl. No.: 16/102,127

(22) Filed: Aug. 13, 2018

(30) Foreign Application Priority Data

Jun. 1, 2018 (TW) ..... 107119007 A

(51) Int. Cl.

| | |
|---|---|
| ***H01Q 1/38*** | (2006.01) |
| ***H01Q 5/371*** | (2015.01) |
| ***H01Q 1/48*** | (2006.01) |
| ***H01Q 1/36*** | (2006.01) |
| ***H01Q 3/22*** | (2006.01) |

(52) U.S. Cl.
CPC ..... *H01Q 5/371* (2015.01); *H01Q 1/36* (2013.01); *H01Q 1/48* (2013.01); *H01Q 3/22* (2013.01)

(58) Field of Classification Search
CPC ..... H01Q 5/371
USPC ..... 343/700 R
See application file for complete search history.

(56) References Cited

U.S. PATENT DOCUMENTS 6,384,479 B1 * 5/2002 Yamamoto ..... H01L 23/528 257/728
2013/0321212 A1 * 12/2013 O'Shea ..... H01Q 1/38 343/700 MS

* cited by examiner

*Primary Examiner* — Peguy Jean Pierre

(57) ABSTRACT

Disclosures of the present invention describe an antenna device by forming a HF conductive section, a ground electrode, two first LF conductive sections, two first bending conductive sections, two second LF conductive sections, and a second bending conductive section on one surface of a substrate as well as disposing a cover electrode on the other surface of the same substrate. The HF conductive section is designed to have an area extending portion for making a horizontal electrical coupling occur between the area extending portion and the two LF conductive sections. Moreover, the cover electrode covers a portion of the second bending conductive section, all of the ground electrode, a portion of the signal inputting portion, and a portion of the two LF conductive sections, such that a vertical electrical coupling is achieved for enhancing the efficiency of the antenna device during the transmission of LF signal.

9 Claims, 6 Drawing Sheets

ANTENNA DEVICE

BACKGROUND OF THE INVENTION

1. Field of the Invention

The present invention relates to the technology field of antennas, and more particularly to an antenna device having advantages of high efficiency, broad bandwidth and outstanding VSWR (voltage standing wave ratio).

2. Description of the Prior Art

With the well development of IoT (Internet of Things) and cloud computing technologies, wireless communication industry has consequently become a flourishing industry. The best evidence is that various electronic devices and home appliances commonly used in human life are all equipped with at least one kind of wireless transmission interface nowadays. These various electronic devices and home appliances with wireless communication capability are known certainly linking to Internet through a local WiFi AP (access point) or router. On the other hand, due to the fact that fourth generation (4G) of broadband cellular network technology has been widely implemented in various applications of wireless communication as well as fifth generation (5G) of broadband cellular network technology has been well-developed, WiFi AP or router is correspondingly designed to has capability of converting not only Ethernet signal but also 4G, 4G LTE and/or 5G wireless signals to a corresponding WiFi signal.

It needs to know that each wireless standard may have different frequency bands. For example, 4G LTE may operate on frequency bands in a range around 1800 MHz (Band 3), 900 MHz (Band 8) and 700 MHz (Band 28). Wireless signal with central (or operation) frequency of 900 MHz or 700 MHz is classified as a low-frequency wireless signal, which is found to possess some characteristics including long wavelength, non-directionality, high transmission power, and less diffraction attenuation. On the contrary, Wireless signal with central frequency of 1800 MHz is classified as a high-frequency wireless signal also possessing some characteristics, including short wavelength, directionality, poor diffraction performance, and better penetration. Therefore, Taiwan Patent No. M498974 discloses an antenna device for use in a WiFi AP or router, so as to make the WiFi AP able to efficiently transmit/receive various wireless signals.

FIG. 1 shows a top view of the antenna device disclosed by Taiwan Patent No. M498974. The antenna device 2' comprises: a substrate 20', a radiation electrode 21' comprising a first radiation portion 211' and a second radiation portion 212', a high-frequency conductive path 22', two first low-frequency conductive paths 23' surrounding the high-frequency conductive path 22', and two second low-frequency conductive paths 24' surrounding the first low-frequency conductive paths 23'. Particularly, the high-frequency conductive path 22' is provided with a conductive matching path 25'. Moreover, one end of the conductive matching path 25' is connected to one of the two first low-frequency conductive paths 23', and the other end of the conductive matching path 25' is connected to the other one first low-frequency conductive path 23'. On the other hand, the second low-frequency conductive paths 24' is provided with a plurality of conductive paths 241' with bent shape. From FIG. 1, it is found that the conductive paths 241' face to the conductive matching path 25' of the high-frequency conductive path 22' under the isolation of the first low-frequency conductive paths 23'. During the operation of this antenna device 2', a high-frequency electrical connector 3' is electrically connected to a signal feed-in portion 221' formed on the high-frequency conductive path 22' by a signal inputting terminal 31' thereof. Moreover, a ground terminal 32' of the high-frequency electrical connector 3' is electrically connected to a ground portion 231', wherein the ground portion 231' is connected between the two first low-frequency conductive paths 23', and face to the signal feed-in portion 221' of the high-frequency conductive path 22'.

The antenna device 2' disclosed by Taiwan Patent No. M498974 exhibits outstanding performance on VSWR (voltage standing wave ratio) thereof. Following Table (1) records measurement data of VSWR of the antenna device 2' at different operation frequencies.

TABLE 1

| Frequency | |
|---|---|
| (GHz) | VSWR |
| 0.7 | ~3 |
| 0.96 | ~2.4 |
| 1.7 | ~2.4 |
| 1.9 | ~2.5 |
| 2.0 | ~2.2 |

Although the antenna device 2' possesses outstanding VSWR property, Taiwan Patent No. M498974 does still not provide related measurement data for showing the antenna efficiency of the antenna device 2'. Literature 1 has reported that the lowest standard of antenna efficiency for commercial antenna devices is 50%. Herein, Literature 1 is written by Chu et. al with of "Planar Printed Strip Monopole With a Closely-Coupled Parasitic Shorted Strip for Eight-Band LTE/GSM/UMTS Mobile Phones", and is published on IEEE TRANSACTIONS ON ANTENNAS AND PROPAGATION, 58(10)(2010), pp. 3426-3432. On the other hand, it is noted that the shape and area size of the first radiation portion 211' is different from that of the second radiation portion 212'. Moreover, there are several conductive paths 241' with bent shape formed on the second low-frequency conductive paths 24'. Therefore, engineers skilled in design, layout, and etching of PCB should know that, such complex design of circuit layout certainly make the mass production yield of the antenna device 2' roll off.

From above descriptions, it is clear and understood that how to improve or re-design the antenna device 2' has now became an important issue. Accordingly, inventors of the present application have made great efforts to make inventive research so as to eventually provide an antenna device having advantages of high efficiency, broad bandwidth and outstanding VSWR (voltage standing wave ratio).

SUMMARY OF THE INVENTION

The primary objective of the present invention is to provide an antenna device by forming a high-frequency (HF) conductive section, a ground electrode, two first low-frequency (LF) conductive sections, two first bending conductive sections, two second LF conductive sections, and a second bending conductive section on one surface of a substrate as well as disposing a cover electrode on the other surface of the substrate. In order to increase the bandwidth of the transmission of LF signal, the HF conductive section is particularly designed to have an area extending portion so as to make a horizontal electrical coupling occur between the area extending portion and the two LF conductive sections. Moreover, the cover electrode is arranged to cover a portion of the second bending conductive section, all of the ground electrode, a portion of the signal inputting portion, and a portion of the two LF conductive sections, such that a vertical electrical coupling is achieved for enhancing the efficiency of the antenna device during the transmission of LF signal.

It is worth further explaining that, experimental data have proved that this novel antenna device exhibits outstanding performance on VSWR (voltage standing wave ratio) thereof. Moreover, the experimental data also proved that, not only does this antenna device can transmit HF signals by high antenna efficiency, but the antenna efficiency is also measured to above 65% in the case of the antenna device transmitting LF signals. Obviously, the antenna efficiency of 65% is far better than the lowest standard of antenna efficiency for commercial antenna devices (i.e., 50%).

In order to achieve the primary objective of the present invention, the inventor of the present invention provides one embodiment for the antenna device, comprising:

a substrate;

a radiation electrode, being formed on the top of the substrate;

a high-frequency conductive section, being formed on the top of the substrate; wherein one end of the high-frequency conductive section is connected to the radiation electrode, and the other end of the high-frequency conductive section being used as a signal feed-in portion;

a ground electrode, being formed on the top of the substrate and spaced apart from the signal feed-in portion by a first gap;

two first low-frequency conductive sections, being formed on the top of the substrate and respectively located near the two sides of the high-frequency conductive section so as to be spaced apart from the high-frequency conductive section by a second gap; wherein one of the two first low-frequency conductive sections is connected to a first side of the ground electrode, and the other one first low-frequency conductive section being connected to a second side of the ground electrode; and wherein the first side and the second side are two sides opposite to each other of the ground electrode;

two bending conductive sections, being formed on the top of the substrate and respectively located near the two sides of the high-frequency conductive section so as to be spaced apart from the high-frequency conductive section by the second gap; wherein each of the two bending conductive sections is connected to the each of the two first low-frequency conductive sections;

two second low-frequency conductive sections, being formed on the top of the substrate; wherein each of the two second low-frequency conductive sections is spaced apart from each of the two first low-frequency conductive sections by a third gap; and wherein each of the two second low-frequency conductive sections is connected to each of the two bending conductive sections;

a second bending conductive section, being formed on the top of the substrate and spaced apart from the ground electrode by a fourth gap; wherein the second bending conductive section is connected to the two second low-frequency conductive sections by two ends thereof; and a cover electrode, being connected to the bottom of the substrate, thereby covering a portion of the second bending conductive section, all of the ground electrode, a portion of the signal inputting portion, and a portion of the two low-frequency conductive sections in the case of the isolation of the substrate;

wherein the substrate is further provided with a plurality of through holes thereon, such that the second bending conductive section is electrically connected to the cover electrode via the through holes;

wherein the high-frequency conductive section is further provided with an area extending portion, and the area extending portion being spaced apart from the signal feed-in portion and each of the two first low-frequency conductive sections by a fifth gap and a sixth gap, respectively.

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE PREFERRED EMBODIMENTS

To more clearly describe an antenna device according to the present invention, embodiments of the present invention will be described in detail with reference to the attached drawings hereinafter.

Figure 1:
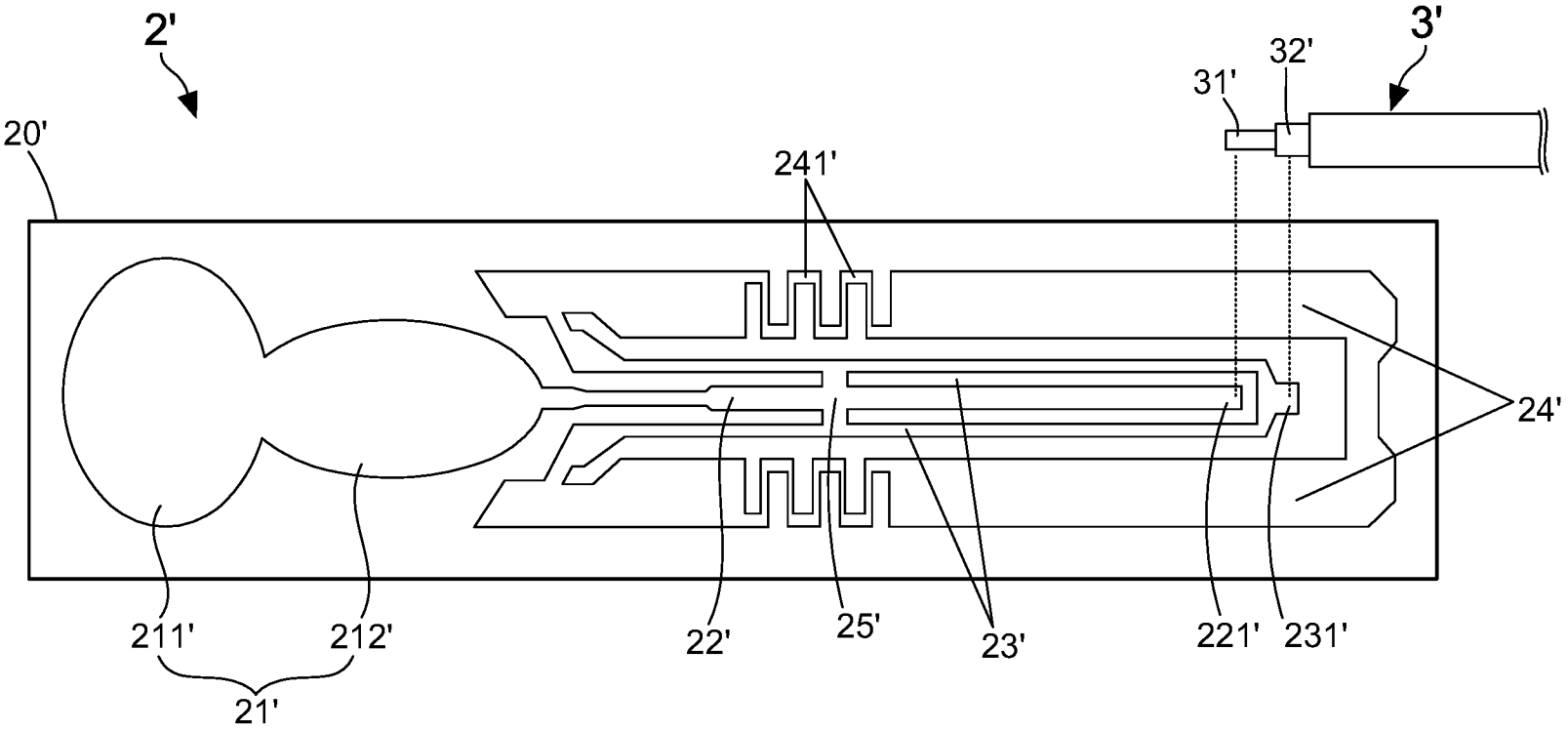
FIG. 1 (Prior art)
FIG. 1 shows a top view of an antenna device disclosed by Taiwan Patent No. M498974.
Figure 2:
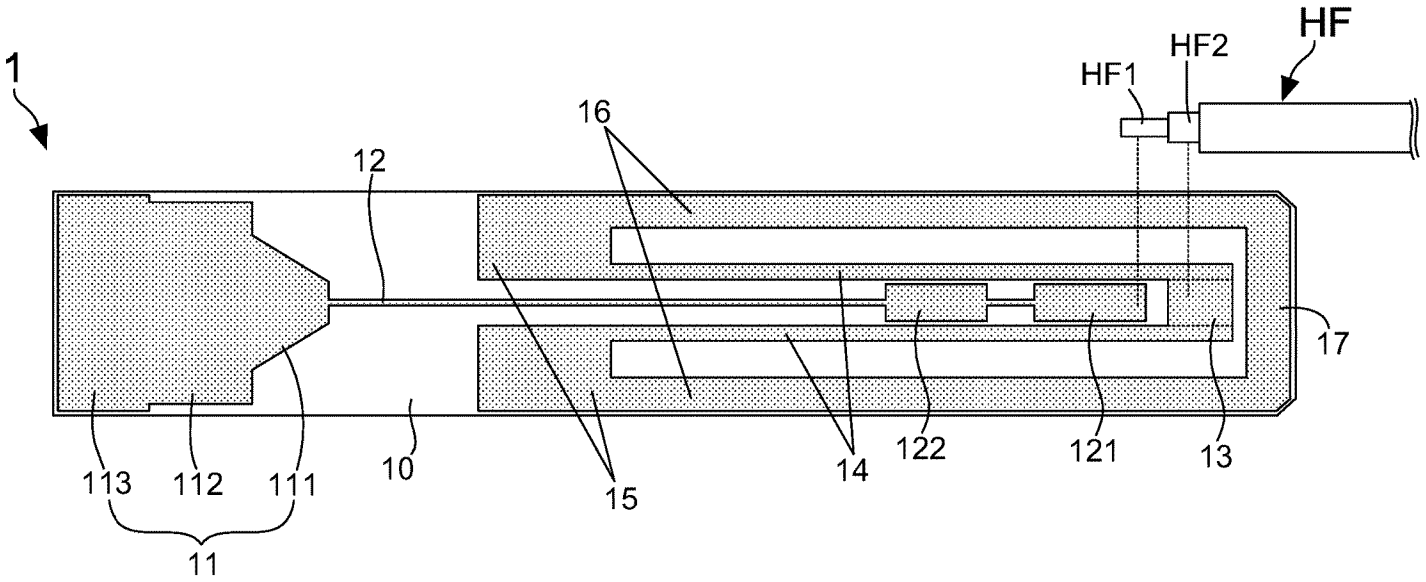
FIG. 2 shows a top view of an antenna device according to the present invention.
Figure 3:
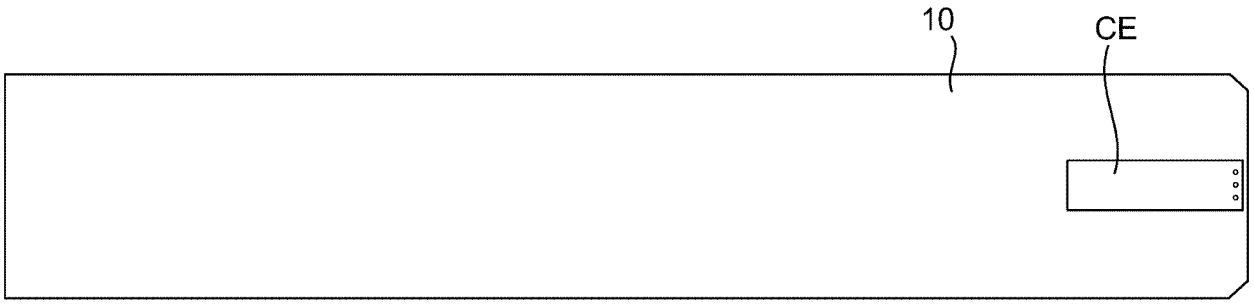
FIG. 3 shows a bottom view of the antenna device according to the present invention.
Figure 4:
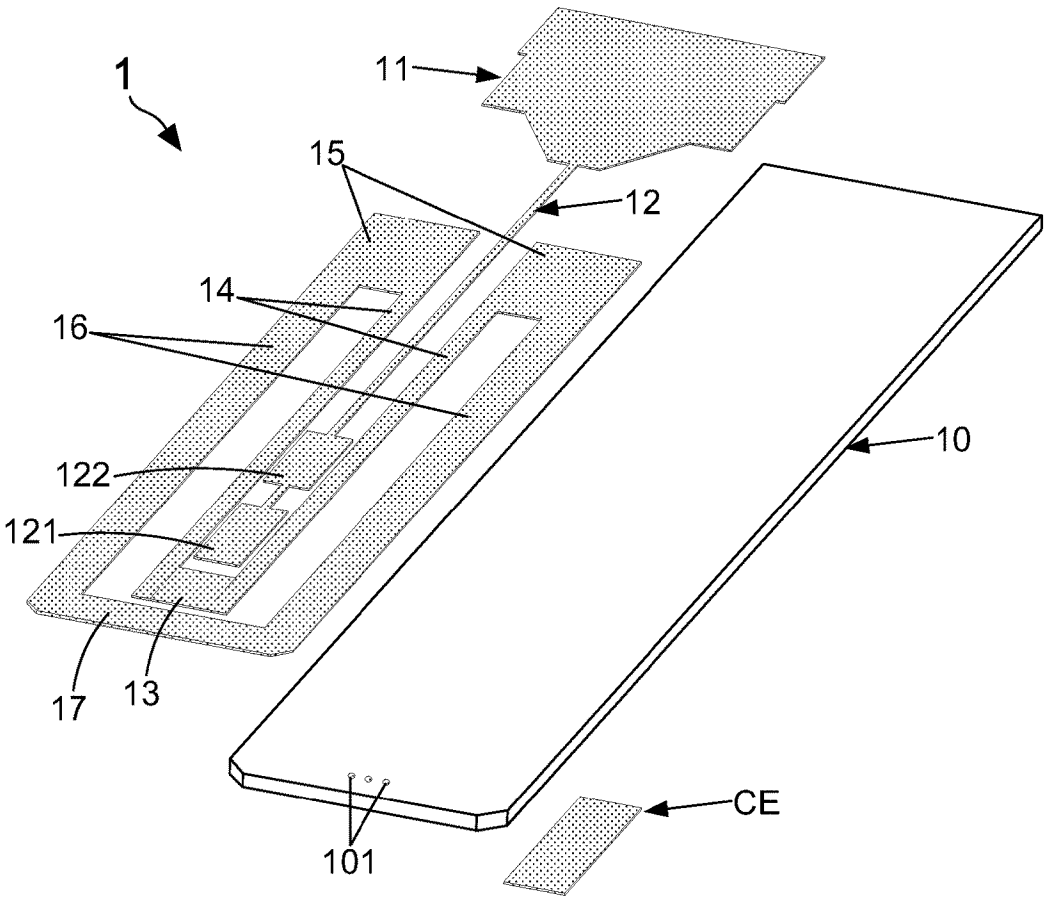
FIG. 4 shows a stereo exploded diagram of the antenna device according to the present invention.

With reference to FIG. 2 and FIG. 3 there are provided a top view and a bottom view of an antenna device according to the present invention. Moreover, FIG. 4 shows a stereo exploded diagram of the antenna device. The antenna device 1 comprises: a substrate 10, a radiation electrode 11, a high-frequency (HF) conductive section 12, a ground electrode 13, two first low-frequency (LF) conductive sections 14, two first bending conductive sections 15, two second LF conductive sections 16, a second bending conductive section 17, and a cover electrode CE. The radiation electrode 11 comprises a first radiation portion 113, a second radiation portion 112 connected to the first radiation portion 113, and a third radiation portion 111 connected to the second radiation portion 112. In the present invention, the third radiation portion 111 is connected to the second radiation 112 and the high-frequency conductive section 12 by a first connection side and a second connection side thereof, and the width of the first connection side is longer than the width of the second connection side.

Figure 5:
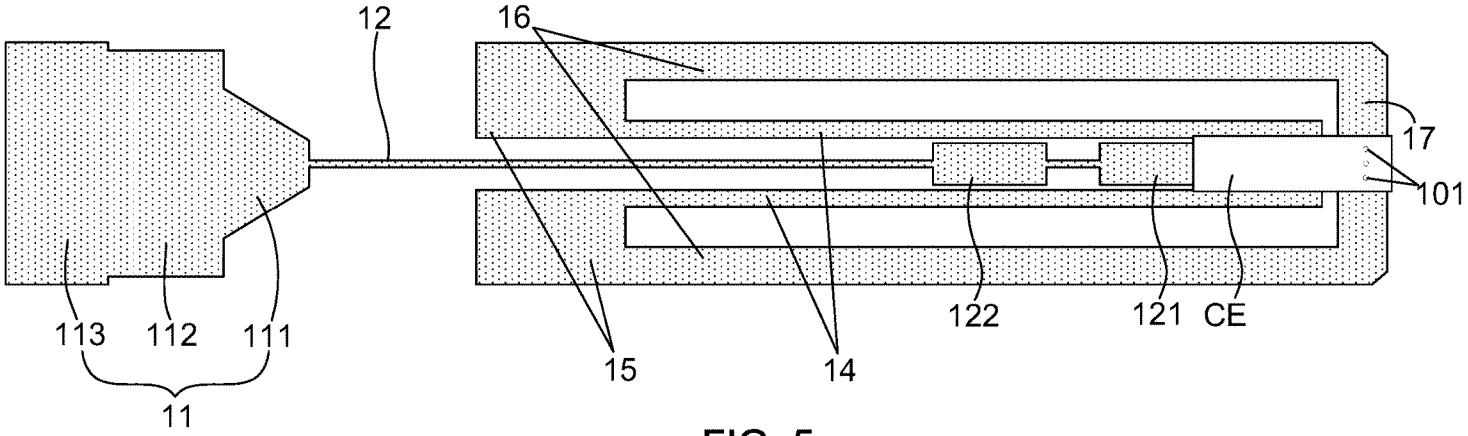
FIG. 5 shows a first top view of a radiation electrode, a high-frequency conductive section, a ground electrode, two first low-frequency conductive sections, two first bending conductive sections, two second low-frequency conductive sections, a second bending conductive section, and a cover electrode.
Figure 6:
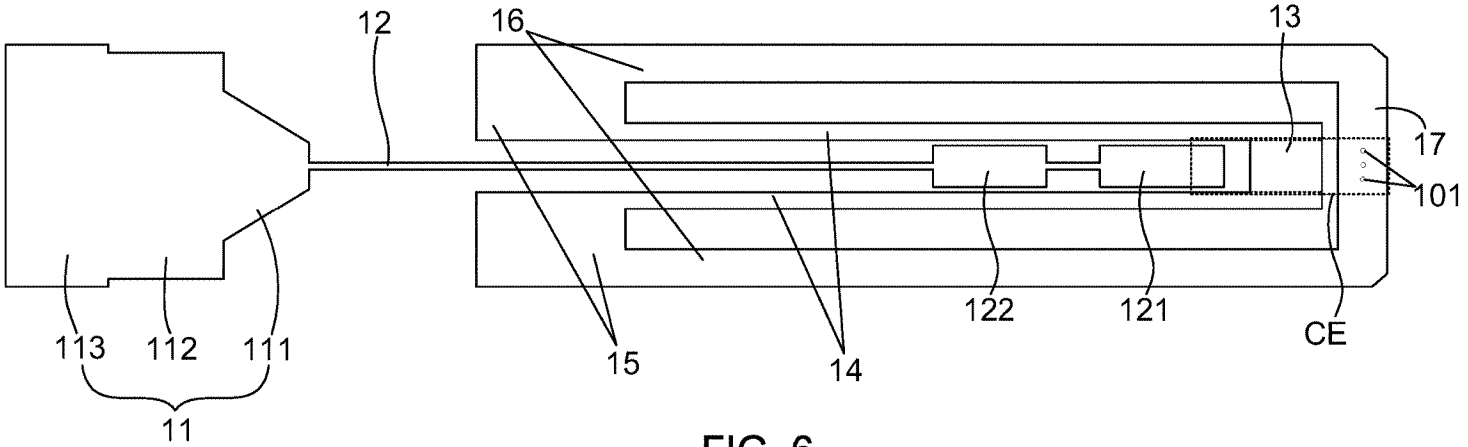
FIG. 6 shows a second top view of the radiation electrode, the high-frequency conductive section, the ground electrode, the two first low-frequency conductive sections, the two first bending conductive sections, the two second low-frequency conductive sections, the second bending conductive section, and the cover electrode.

Continuously referring to FIG. 2, FIG. 3 and FIG. 4, and please simultaneously refer to FIG. 5 and FIG. 6, which illustrate a first top view and a second top view of the radiation electrode 11, the HF conductive section 12, the ground electrode 13, the two first LF conductive sections 14, the two first bending conductive sections 15, the two second LF conductive sections 16, the second bending conductive section 17, and the cover electrode CE. In order to facilitate engineers more understand the structure design of the antenna device 1, in FIG. 5, the areas of the radiation electrode 11, the HF conductive section 12, the ground electrode 13, the two first LF conductive sections 14, the two first bending conductive sections 15, the two second LF conductive sections 16, and the second bending conductive section 17 are all filled with black dots, and the area of the cover electrode CE is filled with white. On the contrary, in FIG. 6, the areas of the radiation electrode 11, the HF conductive section 12, the ground electrode 13, the two first LF conductive sections 14, the two first bending conductive sections 15, the two second LF conductive sections 16, and the second bending conductive section 17 are defined by black lines, and the area of the cover electrode CE is defined by dashed lines.

According to the design of the present invention, the radiation electrode 11 is formed on the top surface of the substrate 10, and the cover electrode CE is connected to the bottom surface of the substrate 10. Herein, top surface means one surface of the substrate 10 and bottom surface denotes to the other one surface of the substrate 10. Briefly speaking, when the radiation electrode 11 is formed on one surface of the substrate 10, the cover electrode CE must be connected to the other one surface of the substrate 10.

The high-frequency conductive section 12 is also formed on the top of the substrate 10, wherein one end of the high-frequency conductive section 12 is connected to the radiation electrode 11, and the other end of the high-frequency conductive section 12 is used as a signal feed-in portion 121. From FIG. 2, FIG. 3, FIG. 4, FIG. 5, and FIG. 6, it is found that the ground electrode 13 is formed on the top of the substrate 10 and spaced apart from the signal feed-in portion 121 by a first gap. On the other hand, the two first low-frequency conductive sections 14 are formed on the top of the substrate 10 and respectively located near the two sides of the high-frequency conductive section 12 so as to be spaced apart from the high-frequency conductive section 12 by a second gap. Particularly, one of the two first low-frequency conductive sections 14 is connected to a first side of the ground electrode 13, and the other one first low-frequency conductive section 14 is connected to a second side of the ground electrode 13, wherein the first side and the second side are two sides opposite to each other of the ground electrode 13. In addition, the two bending conductive sections 15 are formed on the top of the substrate 10 and respectively located near the two sides of the high-frequency conductive section 12 so as to be spaced apart from the high-frequency conductive section 12 by the second gap. Based on the particular design of the present invention, each of the two bending conductive sections 15 is connected to the each of the two first low-frequency conductive sections 14.

From FIG. 2, FIG. 3, FIG. 4, FIG. 5, and FIG. 6, it is further found that the two second low-frequency conductive sections 16 are formed on the top of the substrate 10, wherein each of the two second low-frequency conductive sections 16 is spaced apart from each of the two first low-frequency conductive sections 14 by a third gap. Moreover, each of the two second low-frequency conductive sections 16 is connected to each of the two bending conductive sections 15. On the other hand, the second bending conductive section 17 is formed on the top of the substrate 10 and spaced apart from the ground electrode 13 by a fourth gap, wherein the second bending conductive section 17 is connected to the two second low-frequency conductive sections 16 by two ends thereof. It is worth noting that, the cover electrode CE connected to the bottom of the substrate 10 is adopted for covering a portion of the second bending conductive section 17, all of the ground electrode 13, a portion of the signal inputting portion 121, and a portion of the two low-frequency conductive sections 14 in the case of the isolation of the substrate 10. According to the particular design of the present invention, the substrate 10 is further provided with a plurality of through holes 101 thereon, such that the second bending conductive section 17 is electrically connected to the cover electrode CE via the through holes 101. Besides, the high-frequency conductive section 12 is further provided with an area extending portion 122, and the area extending portion 122 is spaced apart from the signal feed-in portion 121 and each of the two first low-frequency conductive sections 14 by a fifth gap and a sixth gap, respectively.

Herein, it needs to further explain that, both the third gap and sixth gap are wider than the second gap, and the fourth gap is wider than the first gap. Moreover, the width of the fifth gap is designed to be smaller than the length of the area extending portion 122, and the width of the second radiation 112 is smaller than the width of the first radiation portion 113. On the other hand, both the area size of the first bending conductive section 15 and the area size of the second bending conductive section 17 are designed to be larger than the area size of the area extending portion 122 of the high-frequency conductive section 12. In addition, the area size of the third radiation portion 111 is smaller than the area size of the second radiation portion 112, and the signal feed-in portion 121 and the area extending portion 122 have the same area size. Please refer to FIG. 2, FIG. 3, FIG. 4, FIG. 5, and FIG. 6 again, in the present invention, the area size of the portion of the first low-frequency conductive section 14 covered by the cover electrode CE is designed to be smaller than the area size of the portion of the signal inputting portion 121 covered by the cover electrode CE. Moreover, the area size of the portion of the second bending conductive section 17 covered by the cover electrode CE is designed to be larger than the area size of the portion of the signal inputting portion 121 covered by the cover electrode CE.

Figure 7:
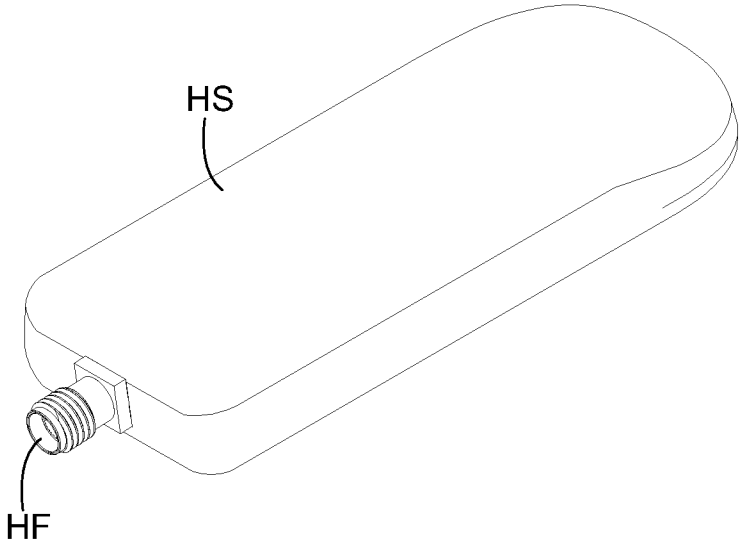
FIG. 7 shows a stereo diagram for depicting a housing case and a HF connector.

Continuously referring to FIG. 2, FIG. 3, FIG. 4, FIG. 5, and FIG. 6, and please simultaneously refer to FIG. 7, which shows a stereo diagram for depicting a housing case and a high-frequency (HF) connector. When implemented this novel antenna device 1 into a WiFi AP or router, the antenna device 1 accommodated in a housing case 4 and connected with a high-frequency electrical connector 3, wherein the high-frequency electrical connector 3 is set to be electrically connected to the signal feed-in portion 121 and the ground electrode 13 by a signal inputting terminal 31 and a ground terminal 32 thereof, respectively. Moreover, the substrate 10, the radiation electrode 11, the high-frequency conductive section 12, the ground electrode 13, the two first low-frequency conductive sections 14, the two bending conductive sections 15, the two second low-frequency conductive sections 16, the second bending conductive section 17, the cover electrode CE, the a signal inputting terminal 31, and the ground terminal 32 are enclosed in the housing case 4.

Technology Features

As FIG. 2 shows, in the present invention, the HF conductive section 12 is particularly designed to have an area extending portion 122 for making a horizontal electrical coupling occur between the area extending portion 122 and the two LF conductive sections 14. Moreover, by letting the cover electrode CE cover a portion of the second bending conductive section 17, all of the ground electrode 13, a portion of the signal inputting portion 121, and a portion of the two LF conductive sections 14, a vertical electrical coupling is achieved for enhancing the antenna efficiency during the antenna device 1 transmitting LF signals.

Experimental Data

Figure 8:
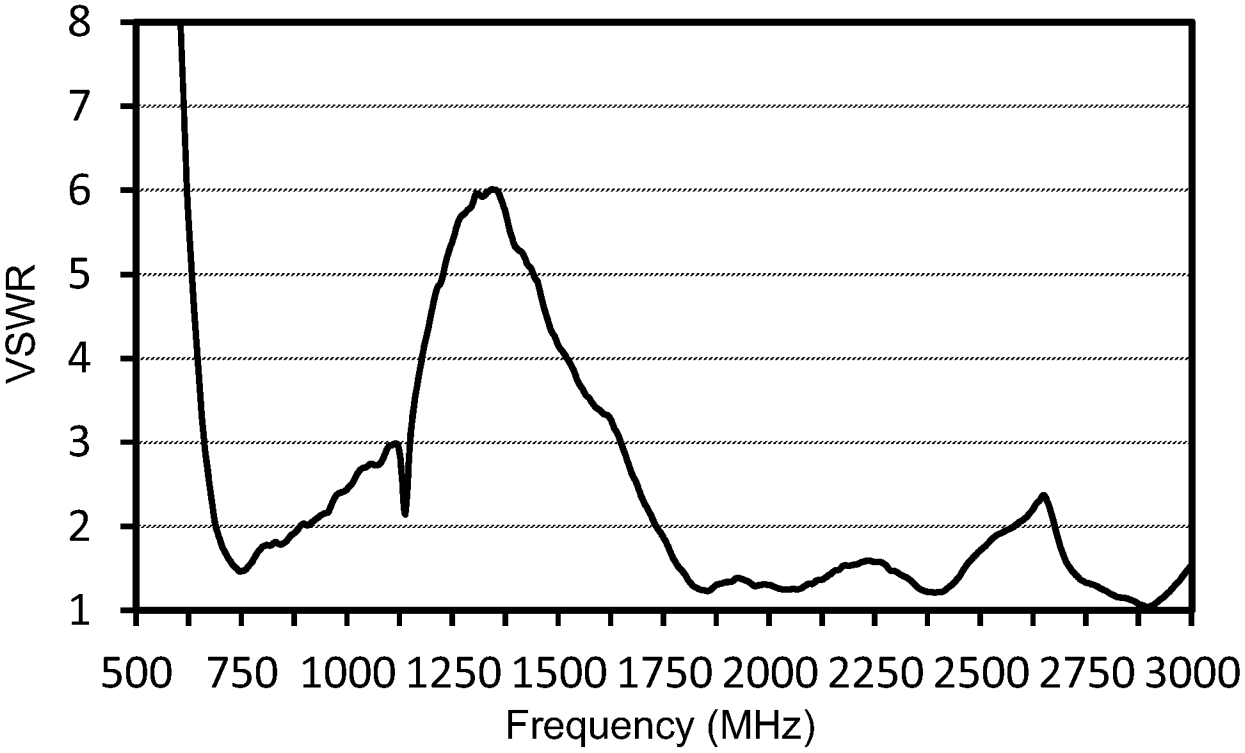
FIG. 8 shows a curve plot of frequency versus VSWR.

FIG. 8 shows a curve plot of frequency versus VSWR (voltage standing wave ratio). From the experiment data of FIG. 5, engineers skilled in design and manufacture of antenna devices should understand that, this novel antenna device 1 is able to exhibit outstanding VSWR even if being operated in high frequency or low frequency. Following Table (2) records measurement data of VSWR and antenna efficiency of the antenna device 1 at different operation frequencies. The experimental data also proved that, not only does this antenna device 1 can transmit HF signals by high antenna efficiency, but the antenna efficiency is also measured to above 65% in the case of the antenna device 1 transmitting LF signals. Clearly, the antenna efficiency of 65% is far better than the lowest standard of antenna efficiency for commercial antenna devices (i.e., 50%).

TABLE 2

| Frequency (MHz) | Antenna efficiency (%) | VSWR |
|---|---|---|
| 704 | 85.04 | 1.74 |
| 716 | 81.75 | 1.62 |
| 734 | 83.19 | 1.51 |
| 746 | 85.59 | 1.46 |
| 756 | 83.36 | 1.48 |
| 777 | 72.76 | 1.60 |
| 787 | 69.8 | 1.69 |
| 824 | 75.88 | 1.8 |
| 849 | 65.57 | 1.8 |
| 869 | 65.13 | 1.9 |
| 894 | 75.6 | 2.03 |
| 1710 | 70.71 | 2.26 |
| 1755 | 82.52 | 1.85 |
| 1850 | 83.79 | 1.23 |
| 1910 | 81.94 | 1.34 |
| 1930 | 84.22 | 1.38 |
| 1990 | 82.86 | 1.31 |
| 2110 | 89.6 | 1.35 |
| 2115 | 83.67 | 1.36 |

Therefore, through above descriptions, the antenna device 1 proposed by the present invention has been introduced completely and clearly; in summary, the present invention includes the advantages of:

(1) The present invention provides an antenna device 1 by forming a high-frequency (HF) conductive section 12, a ground electrode 13, two first low-frequency (LF) conductive sections 14, two first bending conductive sections 15, two second LF conductive sections 16, and a second bending conductive section 17 on one surface of a substrate 10 as well as disposing a cover electrode CE on the other surface of the substrate 10. In order to increase the bandwidth of the transmission of LF signal, the HF conductive section 12 is particularly designed to have an area extending portion 122 so as to make a horizontal electrical coupling occur between the area extending portion 122 and the two LF conductive sections 14. Moreover, the cover electrode CE is arranged to cover a portion of the second bending conductive section 17, all of the ground electrode 13, a portion of the signal inputting portion 121, and a portion of the two LF conductive sections 14, such that a vertical electrical coupling is achieved for enhancing the efficiency of the antenna device 1 during the transmission of LF signal.

(2) It is worth further explaining that, experimental data have proved that this novel antenna device 1 exhibits outstanding performance on VSWR (voltage standing wave ratio) thereof. Moreover, the experimental data also proved that, not only does this antenna device 1 can transmit HF signals by high antenna efficiency, but the antenna efficiency is also measured to above 65% in the case of the antenna device 1 transmitting LF signals. Obviously, the antenna efficiency of 65% is far better than the lowest standard of antenna efficiency for commercial antenna devices (i.e., 50%).

The above description is made on embodiments of the present invention. However, the embodiments are not intended to limit scope of the present invention, and all equivalent implementations or alterations within the spirit of the present invention still fall within the scope of the present invention.

What is claimed is:

1. An antenna device, comprising:

a substrate;

a radiation electrode, being formed on a top surface of the substrate;

a high-frequency conductive section, being formed on the top surface of the substrate; wherein one end of the high-frequency conductive section is connected to the radiation electrode, and the other end of the high-frequency conductive section being used as a signal feed-in portion;

a ground electrode, being formed on the top surface of the substrate and spaced apart from the signal feed-in portion by a first gap;

two first low-frequency conductive sections, being formed on the top surface of the substrate and respectively located near two sides of the high-frequency conductive section so as to be spaced apart from the high-frequency conductive section by a second gap; wherein one of the two first low-frequency conductive sections is connected to a first side of the ground electrode, and the other one first low-frequency conductive section being connected to a second side of the ground electrode; and wherein the first side and the second side are two sides opposite to each other of the ground electrode;

two bending conductive sections, being formed on the top surface of the substrate and respectively located near the two sides of the high-frequency conductive section so as to be spaced apart from the high-frequency conductive section by the second gap; wherein each of the two bending conductive sections is connected to the each of the two first low-frequency conductive sections;

two second low-frequency conductive sections, being formed on the top surface of the substrate; wherein each of the two second low-frequency conductive sections is spaced apart from each of the two first low-frequency conductive sections by a third gap; and wherein each of the two second low-frequency conductive sections is connected to each of the two bending conductive sections;

a second bending conductive section, being formed on the top surface of the substrate and spaced apart from the ground electrode by a fourth gap; wherein the second bending conductive section is connected to the two second low-frequency conductive sections by two ends thereof; and a cover electrode, being connected to a bottom surface of the substrate, thereby covering a portion of the second bending conductive section, all of the ground electrode, a portion of the signal feed-in portion, and a portion of the two low-frequency conductive sections in the case of the isolation of the substrate;

wherein the substrate is further provided with a plurality of through holes thereon, such that the second bending conductive section is electrically connected to the cover electrode via the through holes;

wherein the high-frequency conductive section is further provided with an area extending portion, and the area extending portion being spaced apart from the signal feed-in portion and each of the two first low-frequency conductive sections by a fifth gap and a sixth gap, respectively.

2. The antenna device of claim 1, wherein both the third gap and the sixth gap are wider than the second gap, and the fourth gap being wider than the first gap.

3. The antenna device of claim 1, wherein a width of the fifth gap is smaller than a length of the area extending portion.

4. The antenna device of claim 3, wherein both an area size of the first bending conductive section and an area size of the second bending conductive section are larger than an area size of the area extending portion of the high-frequency conductive section.

5. The antenna device of claim 1, wherein an area size of the portion of the first low-frequency conductive section that is covered by the cover electrode is smaller than an area size of the portion of the signal inputting portion that is covered by the cover electrode, and an area size of the portion of the second bending conductive section that is covered by the cover electrode being larger than an area size of the portion of the signal inputting portion that is covered by the cover electrode.

6. The antenna device of claim 1, wherein the signal feed-in portion and the area extending portion have the same area size.

7. The antenna device of claim 1, wherein the radiation electrode comprises:

a first radiation portion;

a second radiation portion, being connected to the first radiation portion, and wherein a width of the second radiation portion is smaller than a width of the first radiation portion;

a third radiation portion, being connected to the second radiation portion and the high-frequency conductive section by a first connection side and a second connection side thereof; wherein a width of the first connection side is longer than a width of the second connection side.

8. The antenna device of claim 7, wherein an area size of the third radiation portion is smaller than an area size of the second radiation portion.

9. The antenna device claim 1, further comprising:

a high-frequency electrical connector, being respectively electrically connected to the signal feed-in portion and the ground electrode by a signal inputting terminal and a ground terminal thereof; and a housing case for accommodating the substrate, the radiation electrode, the high-frequency conductive section, the ground electrode, the two first low-frequency conductive sections, the two bending conductive sections, the two second low-frequency conductive sections, the second bending conductive section, the cover electrode, the a signal inputting terminal, and the ground terminal.

* * * * *